US007237683B1

(12) United States Patent
Hammers

(10) Patent No.: US 7,237,683 B1
(45) Date of Patent: Jul. 3, 2007

(54) DISPLAY DEVICE FOR COINS, MEDALS AND MEDALLIONS

(76) Inventor: Charles E. Hammers, 1933 Longhorn Dr., Edmond, OK (US) 73003

( * ) Notice: Subject to any disclaimer, the term of this patent is extended or adjusted under 35 U.S.C. 154(b) by 119 days.

(21) Appl. No.: 11/032,560

(22) Filed: Jan. 10, 2005

(51) Int. Cl.
*A47F 7/00* (2006.01)

(52) U.S. Cl. ..... 211/13.1; 248/121; 248/688

(58) Field of Classification Search ..... 248/183.4, 248/178.1, 688, 121, 146; 211/13.1; 206/0.82, 206/0.86, 776
See application file for complete search history.

(56) References Cited

U.S. PATENT DOCUMENTS

| | | | | |
|---|---|---|---|---|
| 1,969,716 | A * | 8/1934 | Cohen | 211/33 |
| 5,080,237 | A * | 1/1992 | Hefner | 211/85.15 |
| 5,188,244 | A * | 2/1993 | Hollstegge | 211/85.15 |
| 5,590,761 | A | 1/1997 | Owen | |
| 5,904,149 | A * | 5/1999 | Ruhl et al. | 132/73 |
| 6,648,283 | B2 * | 11/2003 | Chase et al. | 248/125.1 |
| 2002/0162756 | A1 | 11/2002 | Seligman et al. | |
| 2005/0224665 | A1 * | 10/2005 | Cassavar et al. | 248/146 |

OTHER PUBLICATIONS

Internet Web page article entitled "Military Challenge Coin Display Options", www.militarycoins.us , 10 pp., no date available.
Internet Web page entitled "Airtite Coin Easels," www.wscoin.com , 2 pp. (© 2001).
Internet Web page "Our Handmade Fine American Flag Cases," http://usmedals.com, 2 pp., no date available.
Internet Web page "100 Display Stands for Coin & Proof 2 Sizes," http://cgi.ebay.com, 4 pp., no date available.
Internet Web page "Wooden Display Stand," www.judaism.com, 2 pp., no date available.

* cited by examiner

*Primary Examiner*—Ramon O Ramirez
(74) *Attorney, Agent, or Firm*—McAfee & Taft

(57) ABSTRACT

The current invention provides an improved display device for displaying coins, medals and medallions. The display device is designed to focus the viewer's attention on the object on display without blocking a substantial portion of the object from the view. Additionally, the current invention provides a display device suitable for displaying a coin, medal or medallion along with a related secondary object. Finally, the current invention provides a device suitable for display a plurality of coins, medals or medallions.

38 Claims, 10 Drawing Sheets

DISPLAY DEVICE FOR COINS, MEDALS AND MEDALLIONS

BACKGROUND OF THE INVENTION

The current invention relates to display devices particularly suited for showcasing medals, medallions and coins. While display stands for exhibiting objects such as medals are available, many such devices preclude viewing of the entire object. For example, devices such as easels and display racks do not allow for easy viewing of the reverse side of a coin or medal and frequently block a portion of the obverse side.

Frequently, the armed forces recognize individual and unit performance by awarding medallions. Currently available display racks do not present such medallions with the degree of prominence and access befitting such honors. Further, the available display devices are not adaptable to displaying the medallion with another related object. Therefore, a need exists for a display device that prominently exhibits the medallion, coin or medal without blocking a substantial portion of the item on display. Additionally, a need exists for a display device adaptable to displaying the medallion, coin or medal in conjunction with another object related to the subject matter of the award.

SUMMARY OF THE INVENTION

The current invention provides a device for displaying objects such as coins, medals and medallions. In one embodiment, the current invention comprises a pedestal, a first support member and a second support member carried by the pedestal. The object to be displayed is placed on the pedestal between the first and second support members.

In another embodiment, the display device comprises a substantially vertical support member projecting upwards from the pedestal and an inclined support member. The inclined support member and vertical support member retain the coin, medal or medallion on the pedestal. Optionally, the pedestal may be mounted or carried by a base.

Still further, the present invention provides a device for displaying objects such as coins, medals and medallions in conjunction with another object of interest. The coins, medals or medallions are positioned between a vertical support member and an inclined support member carried by a pedestal. The pedestal is carried by a base and the base further includes an arm suitable for supporting or displaying the other object of interest.

Finally, the current invention provides a device suitable for displaying multiple coins, medals and/or medallions. The device comprises a base having a transverse section and at least two arms joined to the transverse section. At least one pedestal is carried by each arm and the transverse section. The pedestal includes a substantially vertical support member projecting upwards from the pedestal and an inclined support member. The inclined support member and vertical support member retain the coin, medal or medallion on the pedestal.

BRIEF DESCRIPTION OF THE DRAWINGS

FIGS. 6*a* and 6*b* are side views of alternative embodiments of the display device.

DETAILED DESCRIPTION OF THE PREFERRED EMBODIMENT

Figure 1:
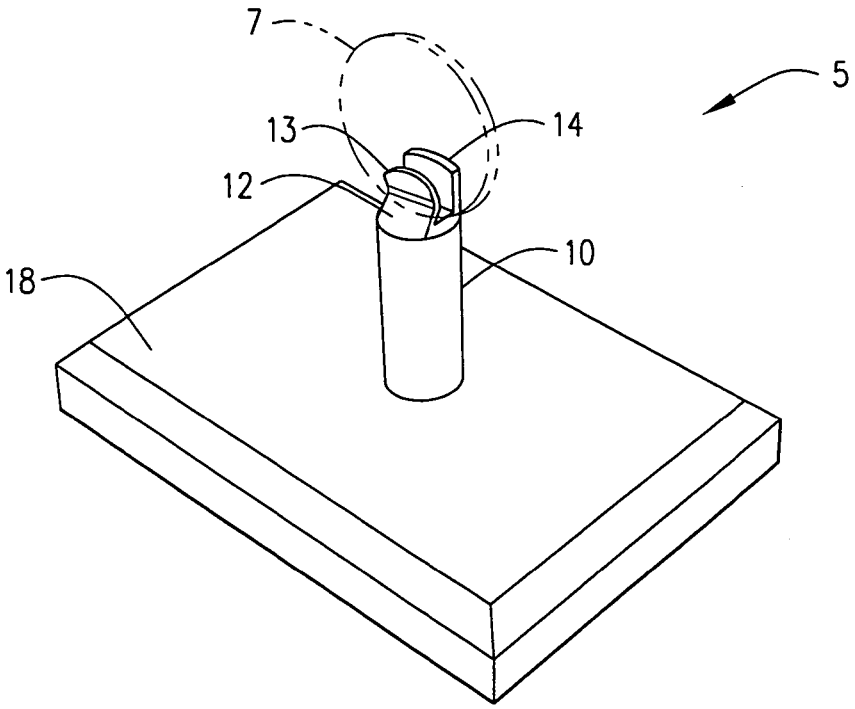
FIG. 1 is a perspective view of one embodiment of the current invention.
Figure 2:
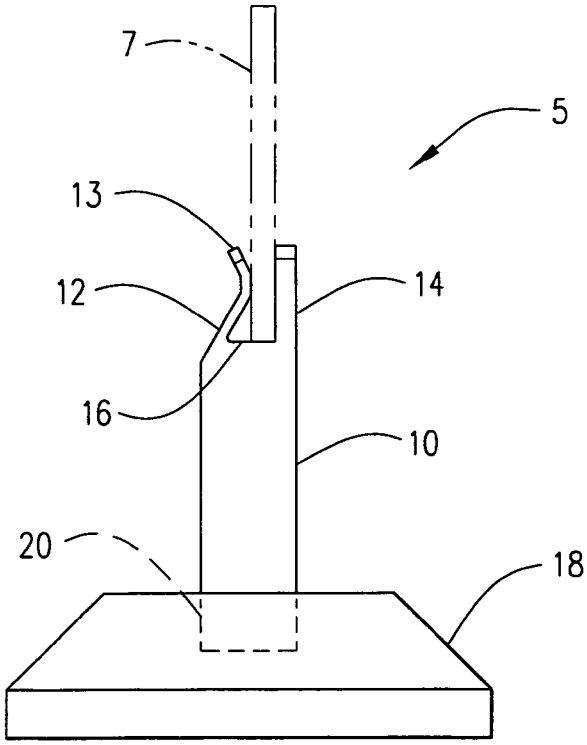
FIG. 2 is a side view of the embodiment depicted in FIG. 1.
Figure 3:
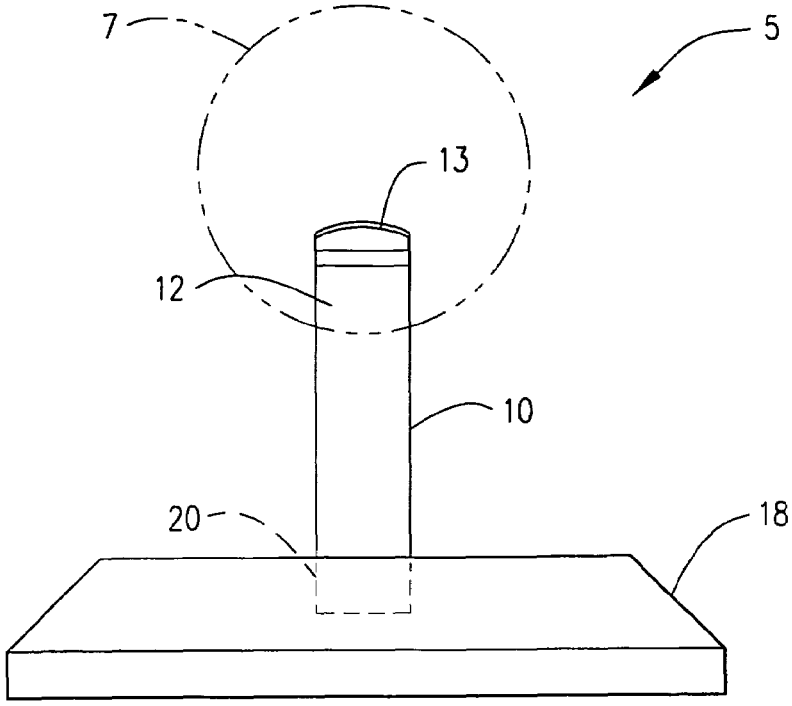
FIG. 3 is a front view of the embodiment depicted in FIG. 1.
Figure 4:
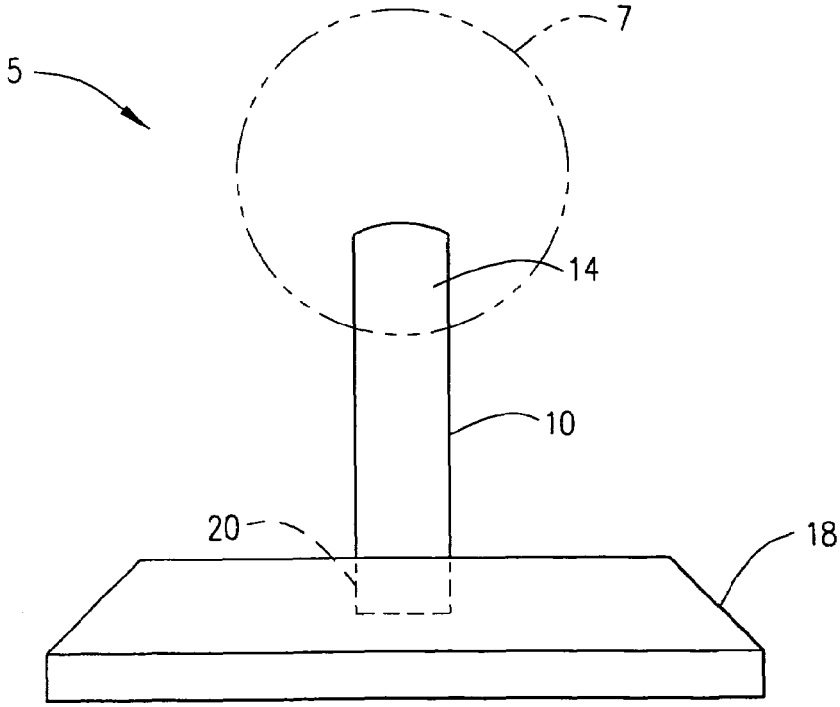
FIG. 4 is a rear view of the embodiment depicted in FIG. 1.
Figure 5:
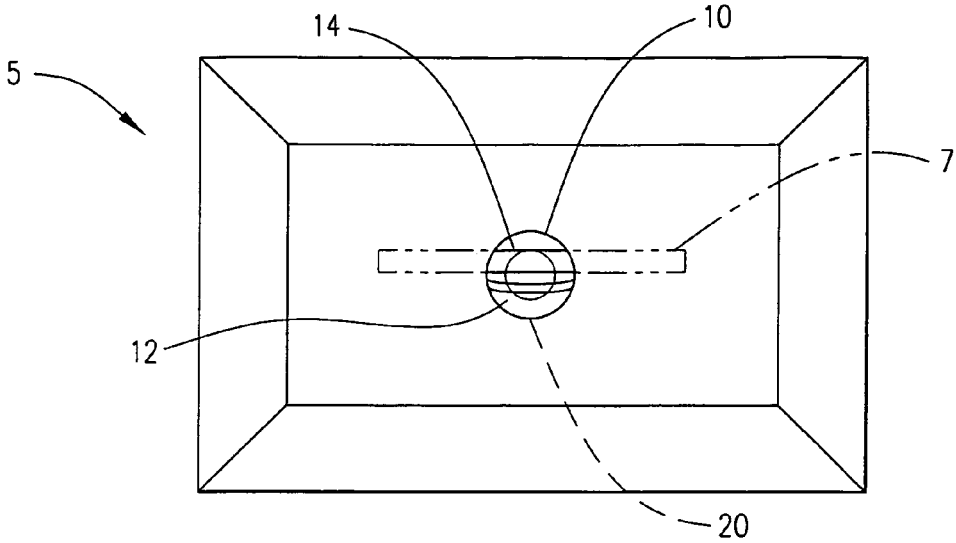
FIG. 5 is a top view of the embodiment depicted in FIG. 1.
Figure 5A:
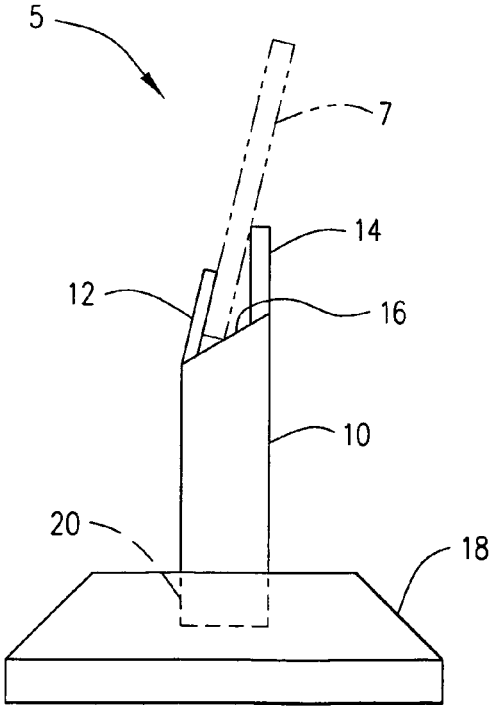
Figure 5B:
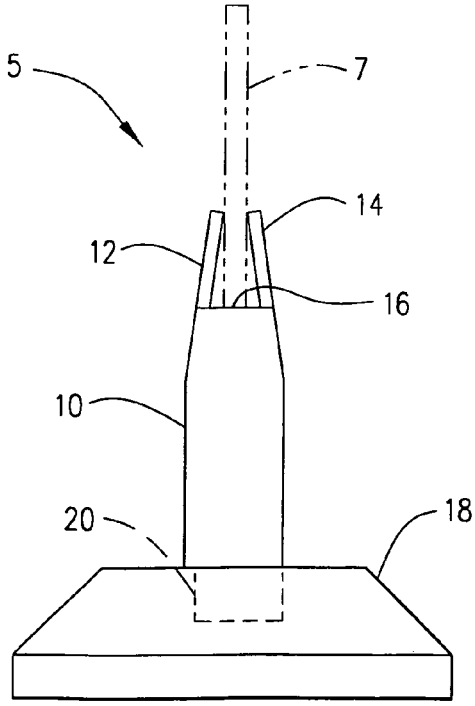
Figure 7:
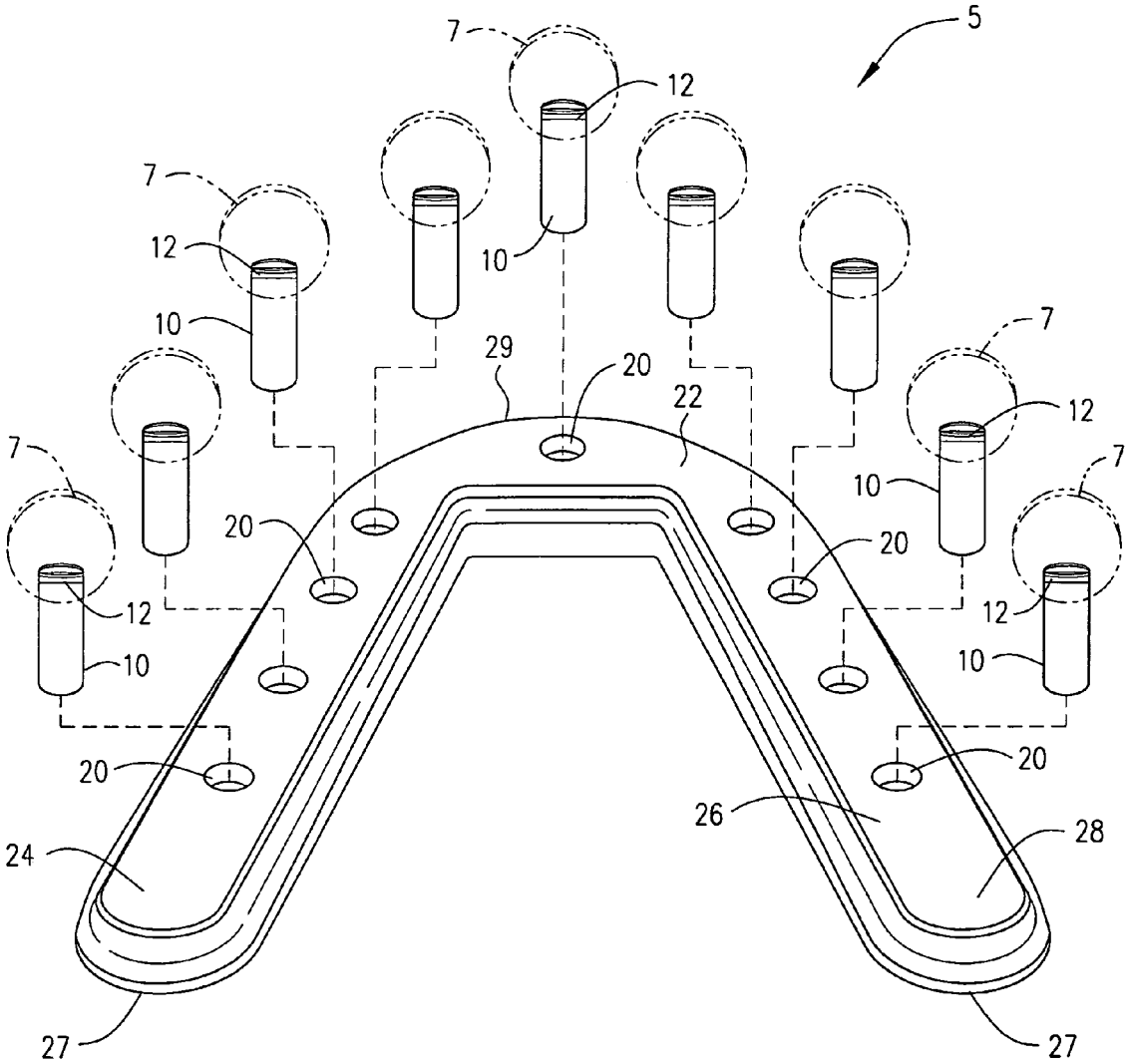
FIG. 7 is a perspective view of an alternative embodiment of the current invention.
Figure 8:
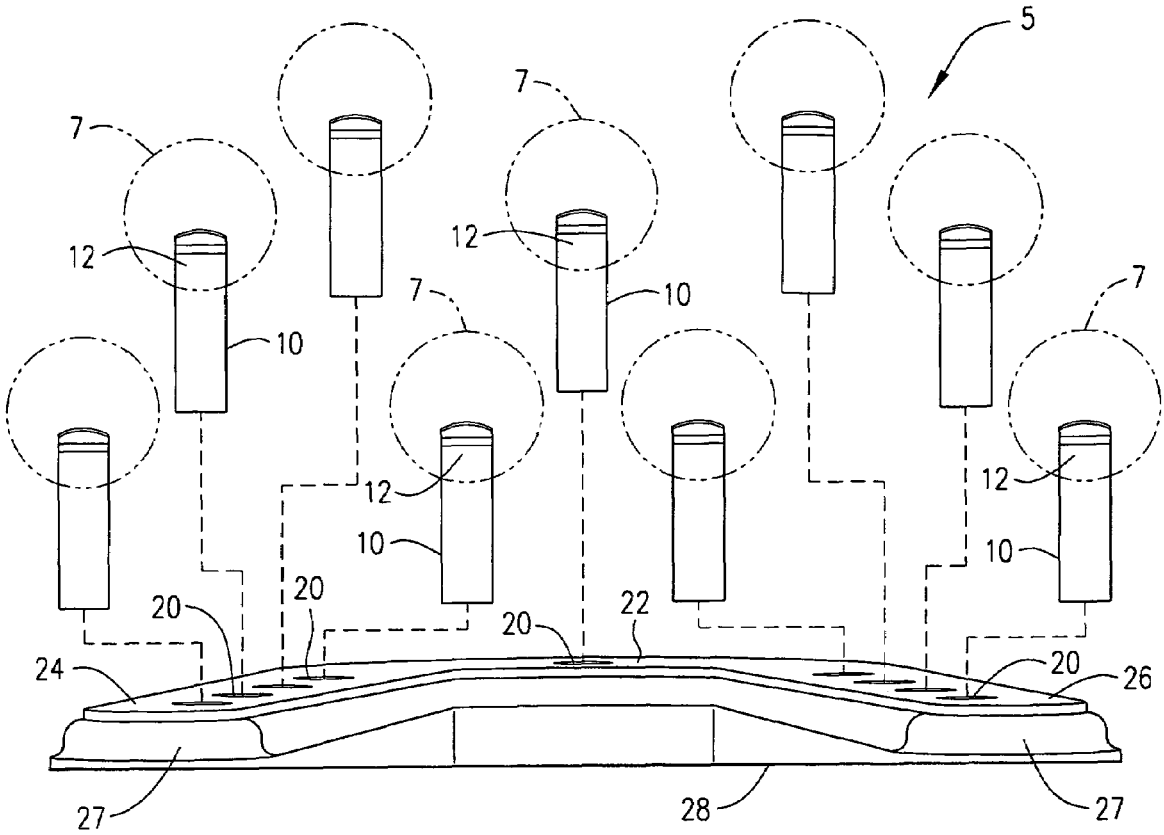
FIG. 8 is a front view of the embodiment depicted in FIG. 7.
Figure 9:
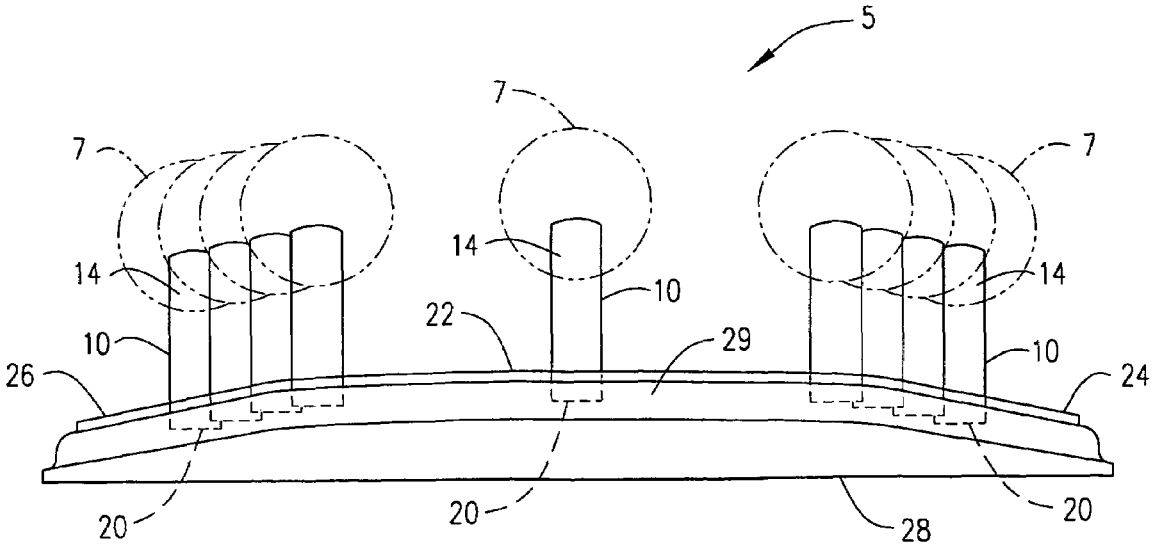
FIG. 9 is a rear view of the embodiment depicted in FIG. 7.
Figure 10:
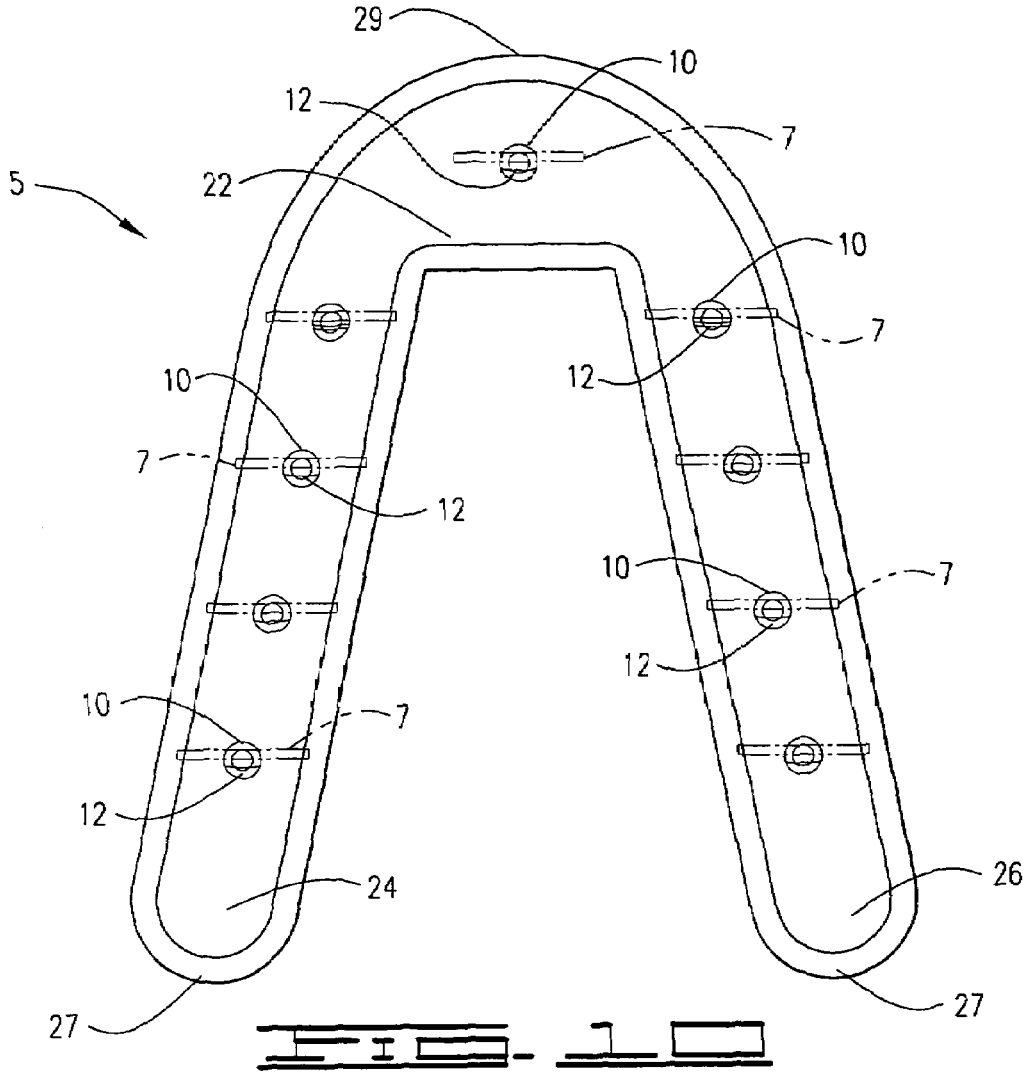
FIG. 10 is a top view of the embodiment depicted in FIG. 7.

One preferred embodiment of the current invention is displayed in FIGS. 1–5. As shown in FIGS. 1–5, the current invention provides a display device 5 suitable for holding an object 7 such as a medallion, coin or medal. Display device 5 comprises a pedestal 10 and two support members 12 and 14. Support member 12 is preferably inclined towards support member 14 at an angle between about 30 degrees and 89 degrees. More preferably, support member 12 is inclined at an angle between about 40 degrees and 80 degrees. As shown in FIG. 1, the preferred embodiment of support member 12 also carries an outwardly projecting lip 13. Lip 13 aids in positioning object 7 between support members 12 and 14.

Preferably, support members 12 and 14 are integrally formed with pedestal 10. However, support members 12 and 14 may be formed separately and subsequently secured by any convenient means to pedestal 10. Object 7 rests on surface 16 between support members 12 and 14.

An alternate embodiment of the current invention is depicted in FIG. 6*a*. In this embodiment, surface 16 is inclined at an angle between about 20 and about 45 degrees from horizontal. Support member 12 is angled between about 0 and about 15 degrees from vertical towards support member 14. As depicted, this embodiment displays object 7 at an angle other than vertical.

Another embodiment of the current invention is depicted in FIG. 6*b*. In this embodiment, support members 12 and 14 are inclined towards each other with each having an angle between about 0 degrees and about 15 degrees from vertical.

Each embodiment of display device 5 is designed to focus the viewer's attention on object 7. Thus, to preclude obstruction of object 7, support members 12 and 14 are formed from a transparent material. For example, use of clear plastic compounds such as, but not limited to, polycarbonate, polystyrene, polyacrylonitrile or any other similar substance to form support members 12 and 14 will permit unobstructed viewing of object 7. Alternatively, support member 12, 14 may be formed from glass. More preferably, pedestal 10 and support members 12, 14 are prepared from the same substantially transparent material. As noted above, in the preferred embodiment, support members 12, 14 are integrally formed with pedestal 10. For example, pedestal 10 and support members 12, 14 may be formed in a single step by injection molding.

While display device 5 has been described only with regard to pedestal 10, surface 16 and support members 12, 14, the current invention also contemplates the provision of a base 18 as depicted in FIGS. 1–5. As part of display device 5, base 18 supports pedestal 10. In the preferred embodiment, base 18 is prepared from wood and has at least one hole 20 sized to receive pedestal 10. Alternatively, base 18 and pedestal 10 may be prepared as an integral unit from a single composition. For example, base 18, pedestal 10 and support members 12, 14 may be formed in a single step by injection molding, casting or other similar technique.

A further embodiment of the current invention is depicted in FIGS. 7–11. As shown therein, several objects 7 are displayed by a single embodiment of the current invention. The embodiment of the current invention depicted in FIGS. 7–11 comprises a base 28, suitable for supporting a plurality of pedestals 10. In this embodiment, base 28 has a transverse section 22 and at least two arms 24 and 26 joined to transverse section 22. In a preferred embodiment, at least one pedestal 10 is carried by each arm 24 and 26 and by transverse section 22. More preferably, each arm 24 and 26 carries a plurality of pedestals 10 in holes 20. To improve viewing of objects 7, base 28 provides an increase in elevation from leading edge 27 to trailing edge 29 for pedestals 10. The incline of base 28 from leading edge 27 to trailing edge 29 is between about one degree and about 35 degrees. More preferably, the incline is between about 10 degrees and 15 degrees.

Figure 11:
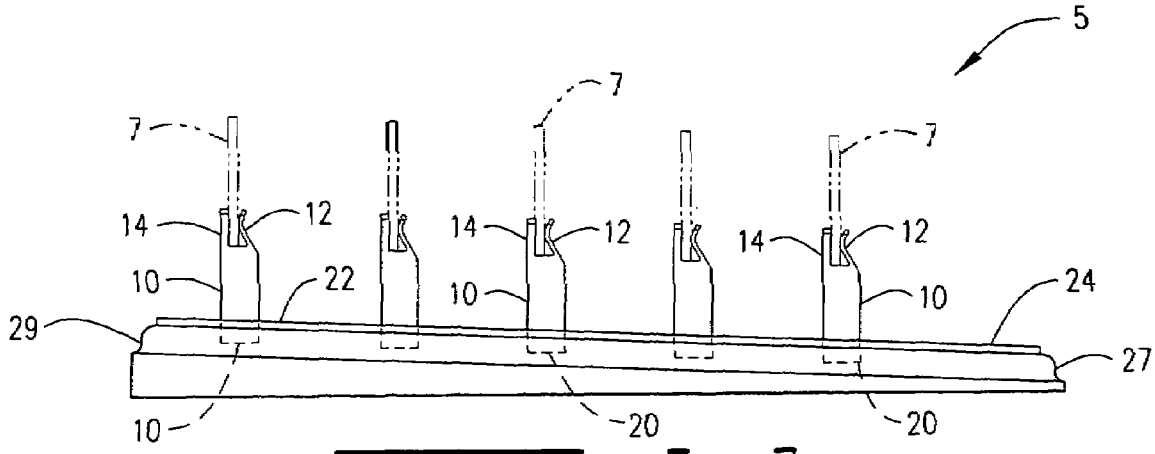
FIG. 11 is a side view of the embodiment depicted in FIG. 7.

In the embodiment of FIGS. 7–11, pedestal 10 has the same optional configurations discussed with regard to FIGS. 1–5. Thus, pedestal 10 preferably carries two support members 12 and 14. Support member 12 is preferably inclined towards support member 14 at an angle between about 30 degrees and 89 degrees. More preferably, support member 12 is inclined at an angle between about 40 degrees and 80 degrees. As shown in FIG. 11, the preferred embodiment of support member 12 also carries an outwardly projecting lip 13. Lip 13 aids in positioning object 7 between support members 12 and 14. In the preferred embodiment, support members 12 and 14 are transparent thereby providing an unobstructed view of object 7. More preferably, support members 12, 14 and pedestal 10 are integrally formed of the same transparent material.

Yet another embodiment of the current invention is depicted in FIGS. 12–16. As shown in FIGS. 12–16, the current invention provides for display of object 7 with a related object 32. The embodiment of FIGS. 12–16 comprises a base 38 and an arm 30. Preferably, arm 30 is an arcuate arm capable of positioning object 32 over object 7. Preferably, object 32 is secured to arm 30 by a screw (not shown) or other similar device passing through a hole 34.

Figure 12:
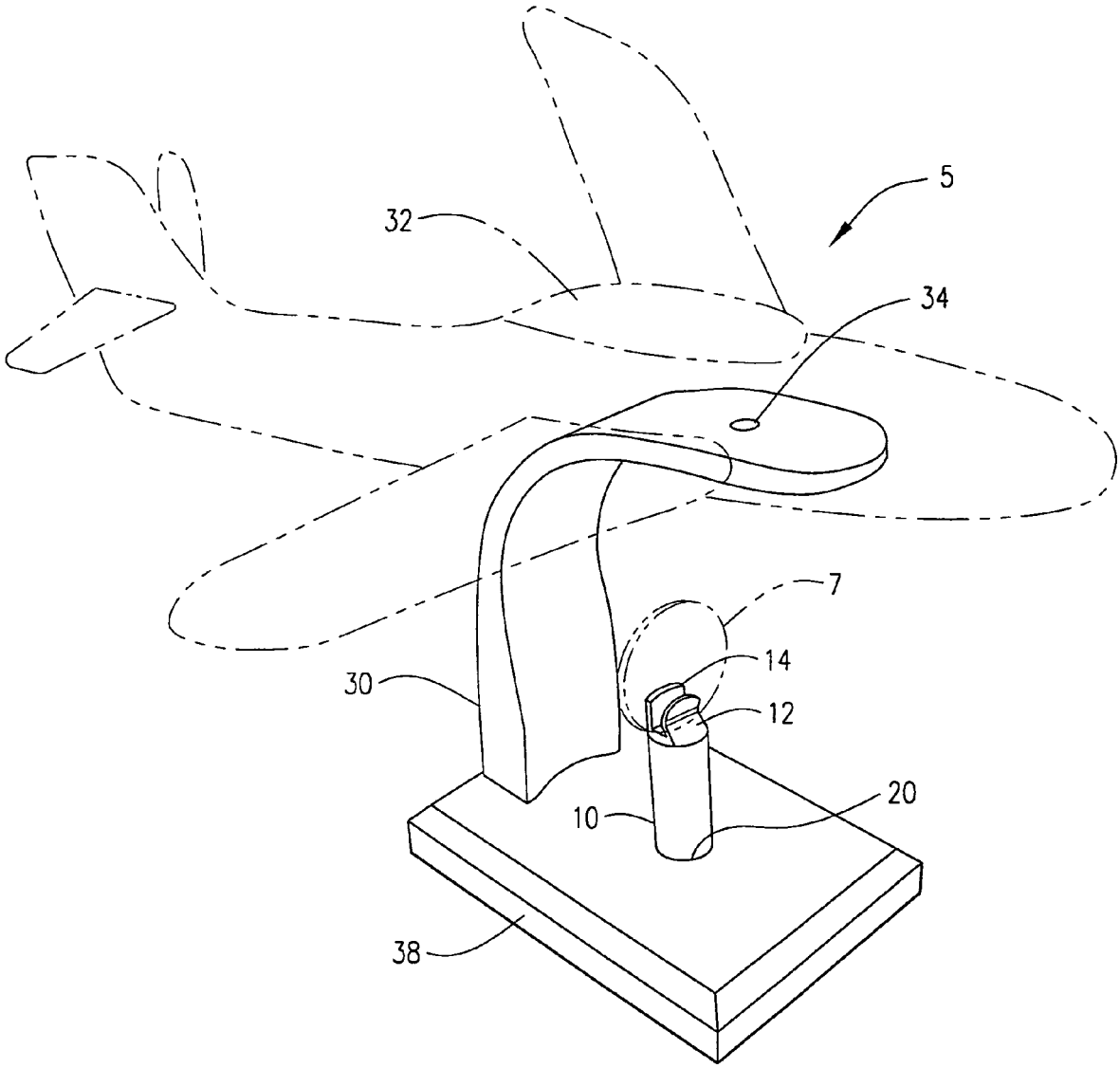
FIG. 12 is a perspective view of another embodiment of the current invention.

The embodiment of display device 5 depicted in FIG. 12 demonstrates the relationship between object 7 and object 32. For example, FIG. 12 depicts object 32 as a model airplane in hidden line format to demonstrate how a secondary object 32 may be displayed in conjunction with object 7. This arrangement is particularly useful for displaying a military award and an object associated with the recipient's military service. Although depicted with only a single pedestal 10, the embodiment of FIGS. 12–16 may be easily combined with the embodiment of FIGS. 7–11 or 17–21 to provide display of related object 32 with multiple related awards.

Figure 13:
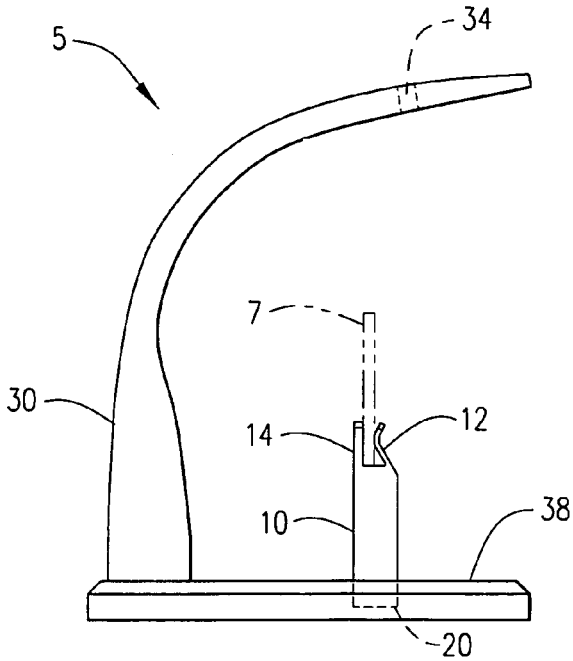
FIG. 13 is a side view of the embodiment depicted in FIG. 12.
Figure 14:
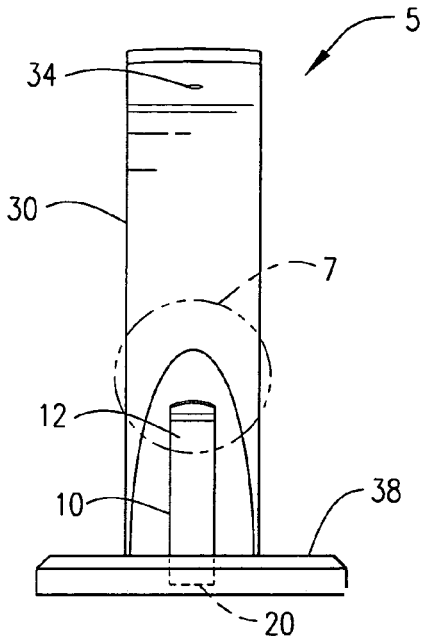
FIG. 14 is a front view of the embodiment depicted in FIG. 12.
Figure 15:
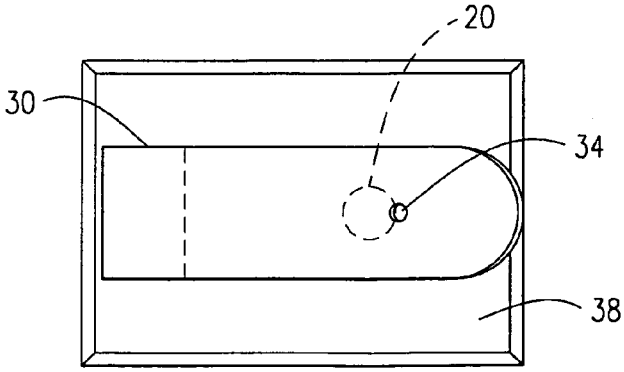
FIG. 15 is a top view of the embodiment depicted in FIG. 12.
Figure 16:
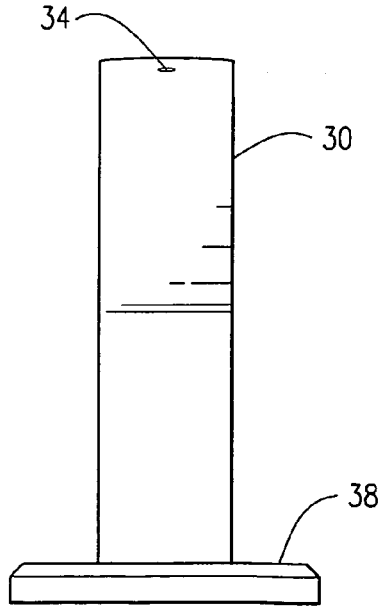
FIG. 16 is a rear view of the embodiment depicted in FIG. 12.
Figure 17:
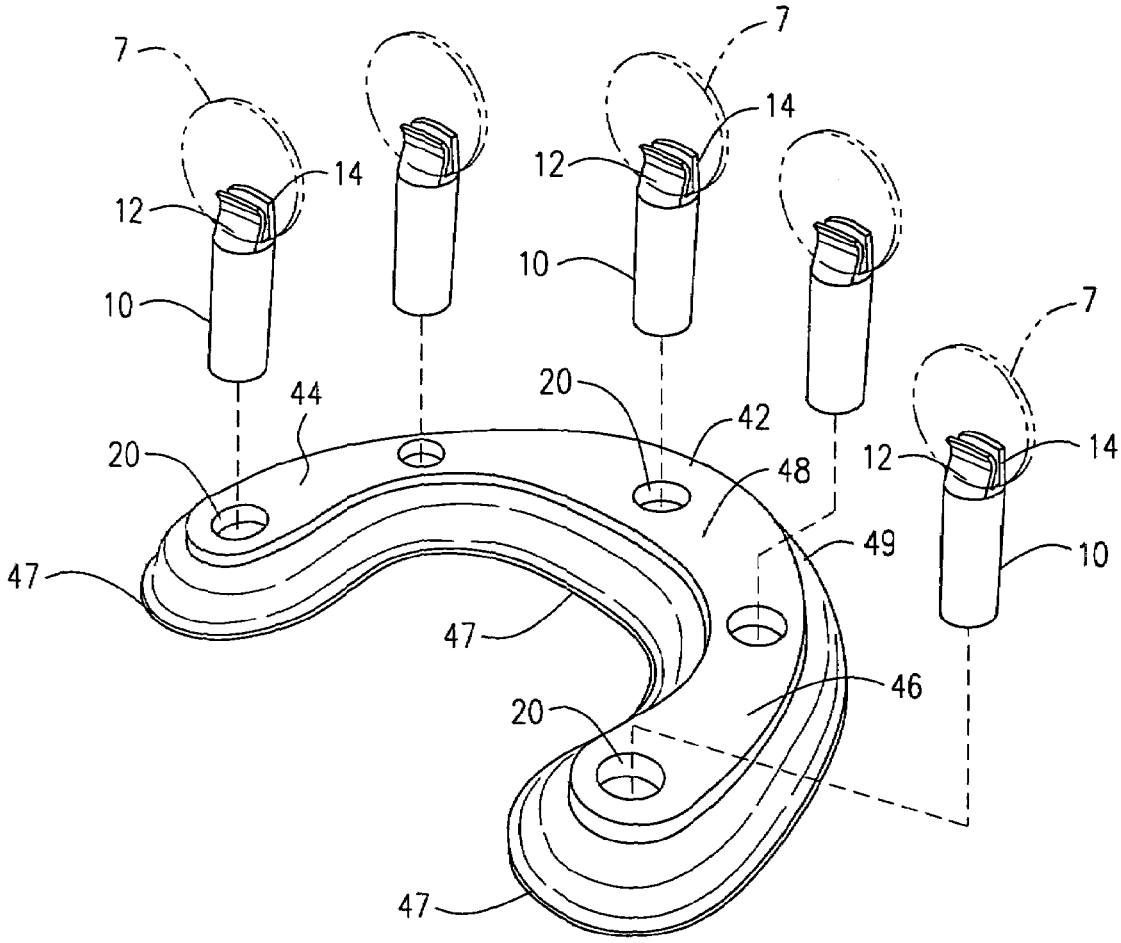
FIG. 17 is a perspective view of another embodiment of the current invention.
Figure 18:
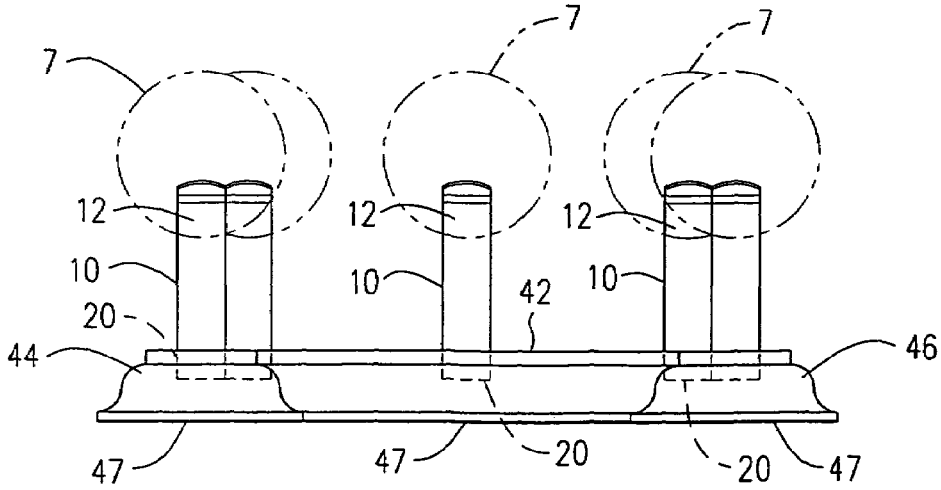
FIG. 18 is a front view of the embodiment depicted in FIG. 17.

In the embodiment of FIGS. 12–16, pedestal 10 has the same optional configurations discussed with regard to FIGS. 1–6*a*, 6*b*. Support member 12 is preferably inclined towards support member 14 at an angle between about 30 degrees and 89 degrees. More preferably, support member 12 is inclined at an angle between about 40 degrees and 80 degrees. As shown in FIG. 13, the preferred embodiment of support member 12 also carries an outwardly projecting lip 13. Lip 13 aids in positioning object 7 between support members 12 and 14. Thus, pedestal 10 preferably carries two support members 12 and 14. In the preferred embodiment, support members 12 and 148 are transparent thereby providing an unobstructed view of object 7. More preferably, support members 12, 14 and pedestal 10 are integrally formed of the same transparent material.

A still further embodiment of device 5 is depicted in FIGS. 17–21. Device 5 of FIGS. 17–21 has a base 48 with a generally horseshoe appearance. In this embodiment, device 5 does not provide an elevational change from leading edge 47 to trailing edge 49.

As shown in FIGS. 17–21, a transverse portion 42 of device 5 joins at least two arms 44 and 46. Transverse portion 42 has at least one hole 20 for receiving pedestal 10. Additionally, each arm 44, 46 has at least one hole 20 for receiving pedestal 10. More preferably, transverse section 42 has at least one hole 20 for receiving pedestal 10 and each arm 44, 46 has at least two holes 20 for receiving pedestals 10.

Figure 19:
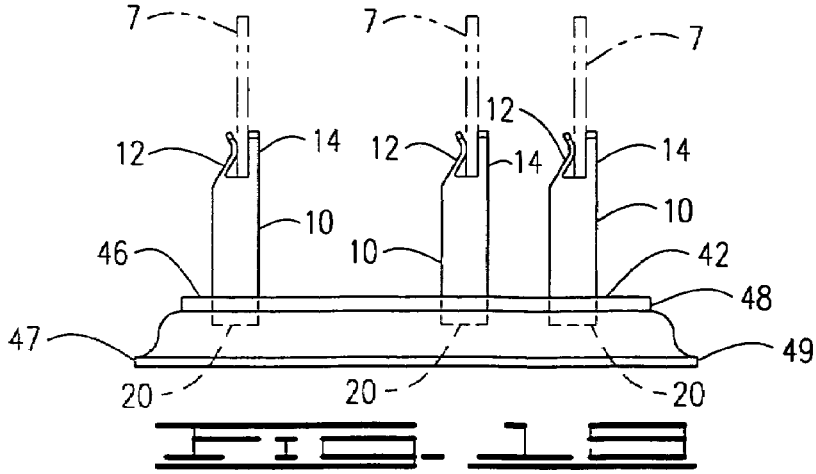
FIG. 19 is a side view of the embodiment depicted in FIG. 17.
Figure 20:
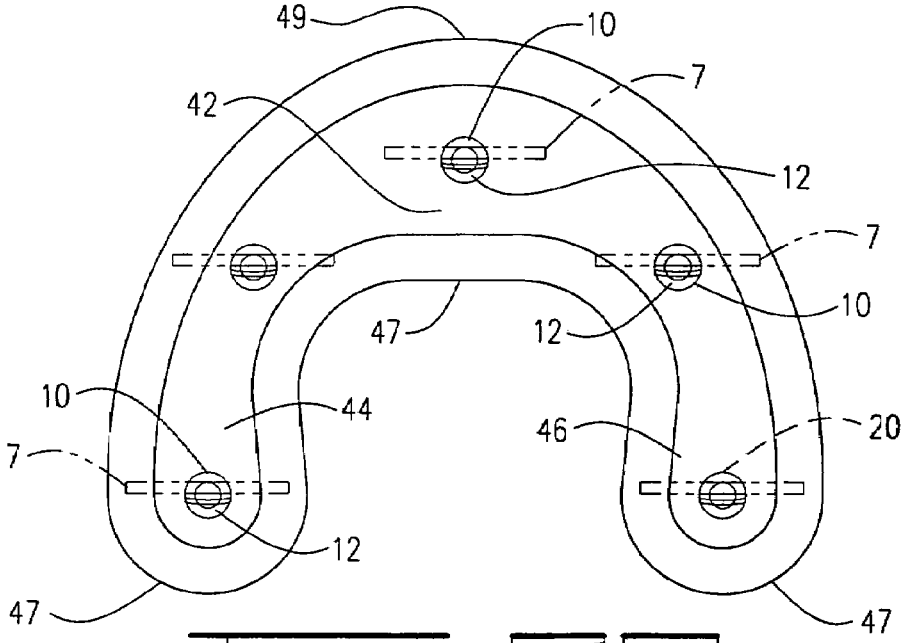
FIG. 20 is a top view of the embodiment depicted in FIG. 17.
Figure 21:
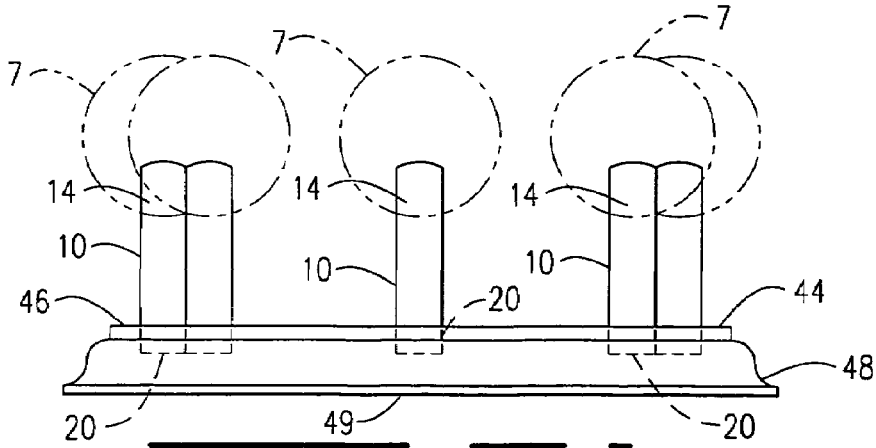
FIG. 21 is a rear view of the embodiment depicted in FIG. 17.

In the embodiment of FIGS. 17–21, pedestal 10 has the same optional configurations discussed with regard to FIGS. 1–6*a*, 6*b*. Thus, pedestal 10 preferably carries two support members 12 and 14. Support member 12 is preferably inclined towards support member 14 at an angle between about 30 degrees and 89 degrees. More preferably, support member 12 is inclined at an angle between about 40 degrees and 80 degrees. As shown in FIG. 19, the preferred embodiment of support member 12 also carries an outwardly projecting lip 13. Lip 13 aids in positioning object 7 between support members 12 and 14. In the preferred embodiment, support members 12 and 14 are transparent thereby providing an unobstructed view of object 7. More preferably, support members 12, 14 and pedestal 10 are integrally formed of the same transparent material.

While the present invention has been described in detail with reference to FIGS. 1–14, other embodiments of the device will be apparent to those skilled in the art. Thus, the foregoing specification is considered exemplary with the true scope and spirit of the invention being indicated by the following claims.

I claim:

1. A device for displaying an object comprising:

at least one pedestal;

a first support member carried by said pedestal;

a second support member carried by said pedestal; and, said pedestal having a surface between said first support member and said second support member said surface suitable for supporting said object when said object is positioned between said first and second support members.

2. The device of claim 1, wherein at least one of said support members is inclined towards the other support member.

3. The device of claim 2, wherein said first and second support members join a surface of said pedestal at an angle of about 30 degrees to about 90 degrees from said surface.

4. The display device of claim 1, wherein at least one support member is substantially transparent.

5. The display device of claim 1, wherein said support members are integrally formed with said pedestal.

6. A device for displaying an object comprising:

at least one pedestal;

a substantially vertical support member projecting upwards from said pedestal;

an inclined support member projecting generally upwards from said pedestal; and, said pedestal having a surface between said first support member and said second support member, said surface suitable for supporting said object when said object is positioned between said first and second support members.

7. The display device of claim 6, wherein said inclined support member is inclined at an angle ranging from about 30 degrees to about 89 degrees from a surface of said pedestal.

8. The display device of claim 6, wherein said inclined support member is inclined at an angle ranging from about 40 degrees to about 80 degrees from said upper surface.

9. The display device of claim 6, wherein said inclined support member is substantially transparent.

10. The display device of claim 6, wherein said vertical and inclined support members are integrally formed with said pedestal.

11. The display device of claim 6, wherein said pedestal, said vertical support member and said inclined support member are substantially transparent.

12. A device for displaying an object comprising:

a base;

at least one pedestal carried by said base;

a substantially vertical support member carried by said pedestal; and, an inclined support member carried by said pedestal, said inclined support member being inclined towards said substantially vertical support member, said pedestal having a surface between said substantially vertical support member and said inclined support member, said surface suitable for supporting said object when said object is positioned between said vertical and inclined support members.

13. The display device of claim 12, wherein said inclined support member is inclined at an angle ranging from about 30 degrees to about 89 degrees from a surface of said pedestal.

14. The display device of claim 12, wherein said inclined support member is inclined at an angle ranging from about 40 degrees to about 80 degrees from a surface of said pedestal.

15. The display device of claim 12, wherein said inclined support member is substantially transparent.

16. The display device of claim 12, wherein said vertical and inclined support members are integrally formed with said pedestal.

17. The display device of claim 12, wherein said pedestal, said vertical support member and said inclined support member are substantially transparent.

18. A device for displaying an object comprising:

at least one pedestal;

a substantially vertical support member projecting upwards from said pedestal;

an inclined support member projecting generally upwards from said pedestal and towards said substantially vertical support member, wherein said object is received between said vertical and inclined support members;

a base having at least one hole suitable for receiving said pedestal; and, an arm rising from said base.

19. The display device of claim 18, wherein said inclined support member is inclined at an angle ranging from about 30 degrees to about 89 degrees from said upper surface.

20. The display device of claim 18, wherein said inclined support member is inclined at an angle ranging from about 40 degrees to about 80 degrees from said upper surface.

21. The display device of claim 18, wherein said inclined support member is substantially transparent.

22. The display device of claim 18, wherein said vertical and inclined support members are integrally formed with said pedestal.

23. The display device of claim 18, wherein said pedestal, said vertical support member and said inclined support member are substantially transparent.

24. The display device of claim 18, wherein said arm is an arcuate arm extending over said pedestal.

25. A device for displaying an object comprising:

a base having a transverse section and at least two arms joined to said transverse section;

at least three pedestals carried by said base wherein at least one pedestal is carried by each of said arms and one pedestal is carried by said transverse section;

a substantially vertical support member projecting upwards from an upper surface of said pedestal; and, an inclined support member projecting generally upwards from said upper surface of said pedestal, said pedestal having a surface between said substantially vertical support member and said inclined support member, said surface suitable for supporting said object when said object is positioned between said vertical and inclined support members.

26. The display device of claim 25, wherein said inclined support member is inclined at an angle ranging from about 30 degrees to about 89 degrees from said upper surface.

27. The display device of claim 25, wherein said inclined support member is inclined at an angle ranging from about 40 degrees to about 80 degrees from said upper surface.

28. The display device of claim 25, wherein said inclined support member is substantially transparent.

29. The display device of claim 25, wherein said vertical and inclined support members are integrally formed with said pedestal.

30. The display device of claim 29, wherein said pedestal, said vertical support member and said inclined support member are substantially transparent.

31. The display device of claim 25, further comprising an arm rising from said base and extending over at least one pedestal.

32. The display device of claim 25, wherein said base has an angle of inclination between about 1 degree and about 35 degrees.

33. The display device of claim 25, wherein said base has an angle of inclination between about 10 degrees and about 35 degrees.

34. A device for displaying an object such as a coin, medal or medallion comprising:

a base;

a substantially transparent pedestal carried by said base;

a substantially vertical support member projecting upwards from an upper surface of said pedestal, said vertical support member is substantially transparent; and, an inclined support member projecting generally upwards from said upper surface of said pedestal, said inclined support member is inclined towards said vertical support member at an angle ranging from about 30 degrees to about 89 degrees from said upper surface and said inclined support member is substantially transparent.

35. The display device of claim 34, wherein said inclined support member is inclined at an angle ranging from about 40 degrees to about 80 degrees from said upper surface.

36. The display device of claim 34, wherein said vertical and inclined support members are integral extensions of said pedestal.

37. A device for displaying an object comprising:

at least one pedestal;

a first support member carried by said pedestal a second support member carried by said pedestal; and, said object being received between said first and second support members, wherein said pedestal has an upper surface inclined from horizontal and said first and second support members are carried by said surface.

38. A device for displaying an object comprising:

a base;

at least one pedestal carried by said base;

a substantially vertical support member carried by said pedestal;

an inclined support member carried by said pedestal, said inclined support member being inclined towards said substantially vertical support member, said object being received between said vertical and inclined support members; and, arcuate arm rising from said base and extending over at least one pedestal.

* * * * *